United States Patent [19]

Burgio, Jr.

[11] Patent Number: 5,048,198

[45] Date of Patent: Sep. 17, 1991

[54] SHUTTER SYSTEM FOR SHIELDING A COATED SUBSTRATE DURING A RADIATION-CURING PROCESS

[76] Inventor: Joseph T. Burgio, Jr., 705 Jennings St., Bethlehem, Pa. 18016

[21] Appl. No.: 439,549

[22] Filed: Nov. 20, 1989

[51] Int. Cl.[5] ..... F26B 3/28

[52] U.S. Cl. ..... 34/4; 219/388

[58] Field of Search ..... 34/1, 4, 60, 39, 41, 34/18; 219/388

[56] References Cited

U.S. PATENT DOCUMENTS

| | | | |
|---|---|---|---|
| 2,127,956 | 8/1938 | Helmer | 34/48 |
| 3,733,709 | 5/1973 | Bassemir et al. | 34/4 |
| 3,745,307 | 7/1973 | Peek, Jr. et al. | 219/388 |
| 3,826,014 | 7/1974 | Helding | 34/1 |
| 3,829,982 | 8/1974 | Pray | 34/4 |
| 3,967,385 | 7/1976 | Culbertson | 34/4 |
| 4,005,135 | 1/1977 | Helding | 250/527 |
| 4,037,329 | 7/1977 | Wallace | 34/4 |
| 4,494,316 | 1/1985 | Stephansen et al. | 34/68 |

*Primary Examiner*—Henry A. Bennett

*Attorney, Agent, or Firm*—Joseph J. O'Keefe; Charles A. Wilkinson

[57] ABSTRACT

A shutter system cooperatively associated with a high temperature lamp-reflector assembly for curing a photosensitive coating on a substrate moving adjacent the lamp-reflector block comprises a reflector block having a cavity within which is mounted a high temperature lamp and a shutter system which includes a double acting cylinder with piston rod, two support-guide rod, bearing assemblies and a flat shutter plate supported in a cantilevered manner from the cylinder piston rod and support-guide rod, bearing assemblies. The shutter plate is moved on signal by the cylinder piston rod to a position between the reflector block and coated substrate to shield the substrate when its movement is interrupted and away from such position when the substrate is moving.

26 Claims, 5 Drawing Sheets

FIG. 4
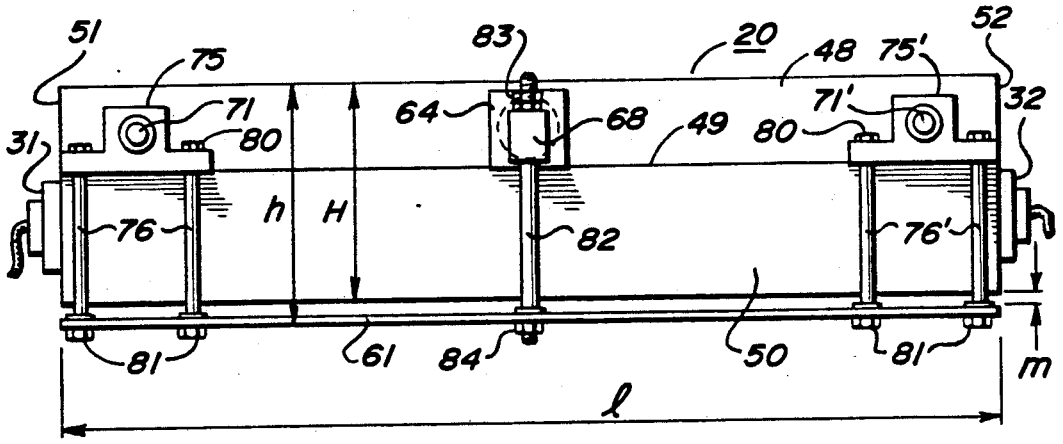
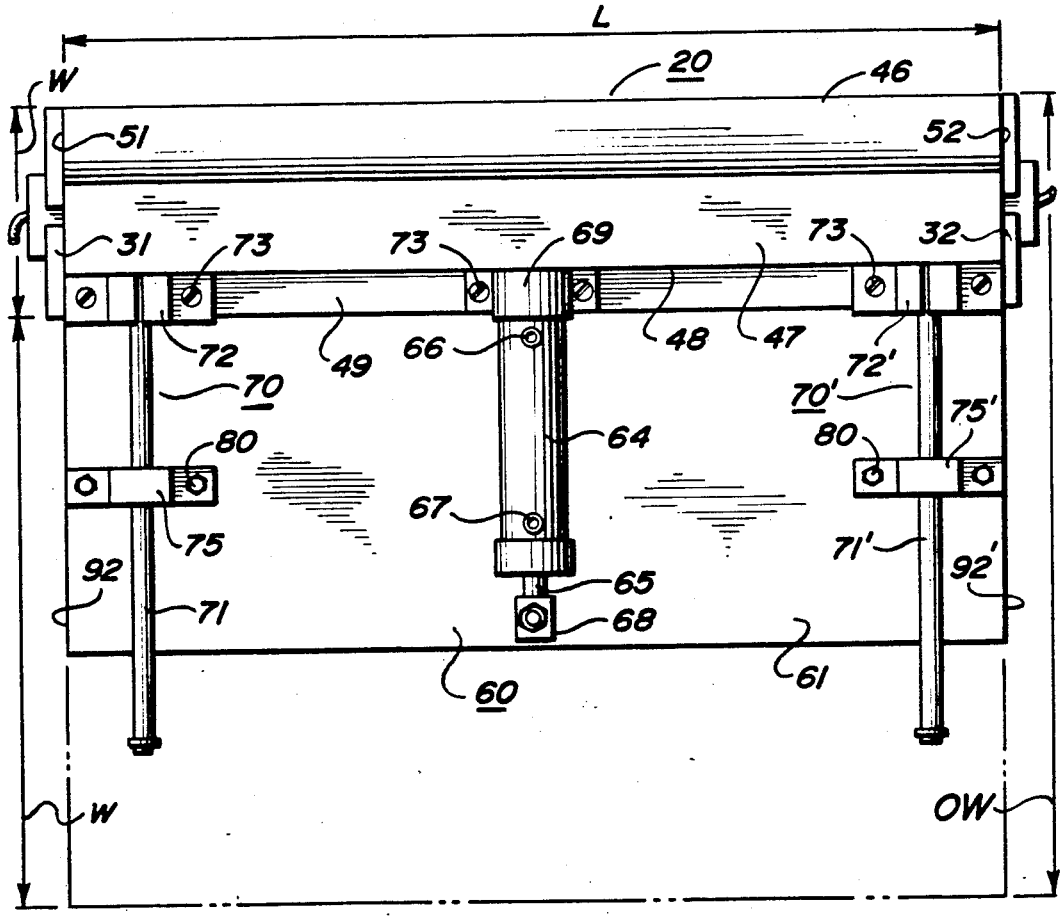
FIG. 5

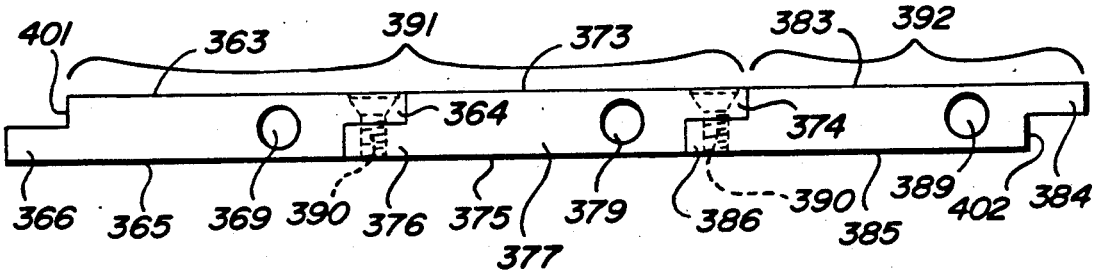
FIG. 8
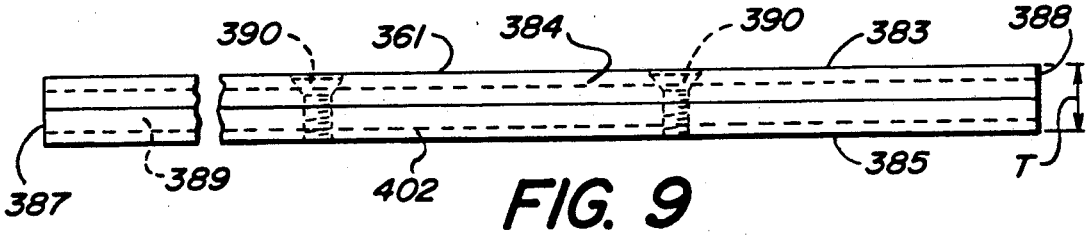
FIG. 9
FIG. 7
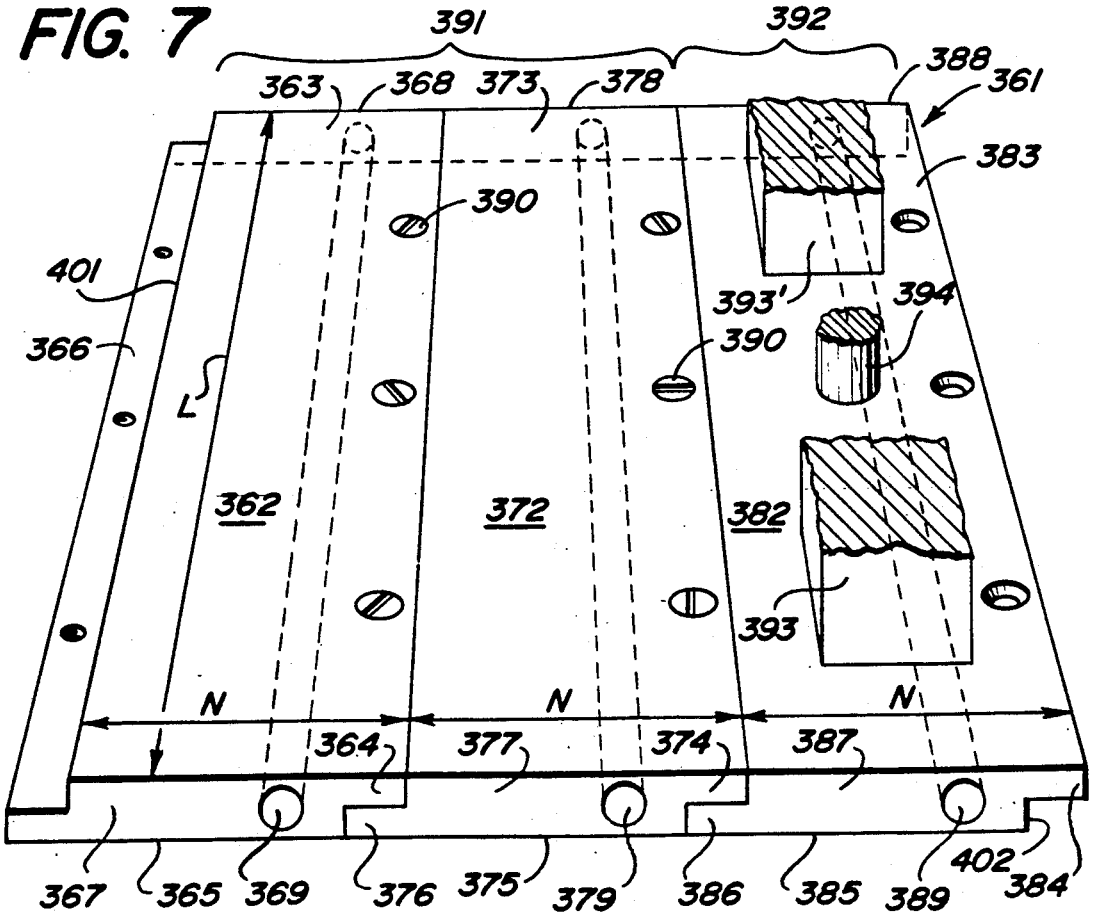

SHUTTER SYSTEM FOR SHIELDING A COATED SUBSTRATE DURING A RADIATION-CURING PROCESS

FIELD OF THE INVENTION

This invention relates to apparatus used in conjunction with a high temperature lamp-reflector assembly for curing a photosensitive coating on a moving substrate, which apparatus is moved between the assembly and substrate to shield the substrate during periods when its movement is temporarily interrupted or stopped. More particularly, this invention is directed to apparatus that is mounted directly upon or adjacent to the lampreflector assembly for reciprocal movement between the lamp and the substrate to shield the substrate from the heat generated by the lamp during those periods when movement of the substrate is interrupted for any reason.

BACKGROUND OF THE INVENTION

The printing field is one of many fields of manufacturing and commercial activity in which coated materials are photochemically cured by means of high temperature curing systems. One such system makes use of ultra-violet radiation from medium pressure mercury vapor lamps, which, by their nature, operate at a temperature of between about 1100° F. to 1400° F. One of the most serious problems associated with such lamps is that the high operating temperatures rapidly dissipate heat to the surrounding areas and adjacent equipment. The ultra-violet lamps are mounted in reflector assemblies, and during normal operations the lamp reflector assemblies are cooled by air and/or water and, in many cases, air is circulated in and around such assemblies and adjacent equipment. The purpose of such cooling is to maintain the lamp reflector assemblies and adjacent equipment at reasonable operating temperatures, and to reduce the amount of heat that is transmitted to the coated substrates. While the cooling is reasonably effective for normal operations, any curtailment of operations, particularly one which interrupts the movement of the coated substrate, either for a short interval or long period, causes substrate temperatures to rise and creates a variety of problems.

One of the general operating parameters of medium pressure mercury vapor lamps is that they cannot cycle from an off-state mode to running power easily. This is due to the fact that such lamps must run at an operating temperature of between about 1100° F. to 1400° F. and whenever a lamp is shut down the mercury therein must be mostly recondensed prior to restriking the lamp arc. Whenever a lamp is shut down, it generally must be cooled below about 800° F. before the re-starting cycle can take place. Another operational feature of such a mercury vapor lamp is that there is an average of four hours of operating life lost each time a lamp arc is restruck. Because of such problems, various types of apparatus have been designed, used and proposed to shield coated substrates from the heat of high temperature lamps whenever movement of such substrates is interrupted, which without shielding could lead to damage of the substrates or require a shut down of the lamps. The purpose of such shielding is not only to protect the substrate, particularly during periods when mechanical problems interrupt movement of the substrate, but to avoid shutting down the lamp which would then require that it go through an extended starting cycle each time the lamp arc is restruck.

Various apparatus and methods have been proposed and used for shielding moving substrates from high temperature lamp sources, such as ultra-violet lamps or infrared red lamps. Generally speaking, such apparatus and/or methods can be classified into two general categories. The first category includes hinged, pivoted or rotated shields and/or light sources. Among them would be the inventions disclosed in U.S. Pat. No. 3,745,307 to R. Nitch, entitled "Dryer for Printing Presses"; U.S. Pat. No. 2,127,956 to R. Helmer, entitled "Method and Apparatus for Drying Printing Ink"; U.S. Pat. No. 3,733,709 to R. W. Bassemir et al., entitled "Reflector and Cooling Means Therefor"; U.S. Pat. No. 3,829,982 to R. W. Pray et al., entitled "Ink Curring and Drying Apparatus"; U.S. Pat. No. 4,005,135 to N. A. Helding, entitled "Rotatable Ultra-Violet Lamp Reflector and Heat Sink"; and U.S. Pat. No. 4,494,316 to E. Stephansen et al., entitled "Apparatus for Drying a Moving Web". The second category includes sliding and reciprocating shutters. Among them would be the inventions disclosed in U.S. Pat. No. 3,826,014 to N. A. Helding, entitled "Shutter Mechanism for Radiation-Curing Lamp"; U.S. Pat. No. 3,967,385 to D. L. Culbertson, entitled "Utilization of Heat Pipes for Cooling Radiation-Curing Systems" and U.S. Pat. No. 4,037,329 to S. J. Wallace, entitled "Shutter and System Employing Same".

The methods and apparatus of the above mentioned patents and other known prior art systems for protecting coated substrates from over-heating, particularly during temporary curtailment of operations, work well initially, but the apparatus traditionally has had a relatively short mechanical life. The extreme heat generated by the ultra-violet lamps causes the shielding apparatus to buckle and warp in a manner which both interferes with its proper operation and reduces its shielding function. Many of the shielding shutters currently available utilize very light-weight metals to reduce the shutter weight in an effort to reduce the total mass of the shutter as the length of the shutter proportionally increases with the increased length of the lamps in wide presses. However, with light-weight material or any shutter material used with large presses, shutters tend to warp and sag because the overall large mass of their sheer size absorbs a large amount of heat during lamp operations.

OBJECTS OF THE INVENTION

Accordingly, it is a main object of the invention to provide a simply constructed, durable and efficiently operating system for shielding, upon signal, a substrate having a photosensitive coating cured by movement adjacent a high-temperature lamp-reflector assembly.

It is another object of the invention to provide a shutter system which can be mounted on or adjacent to such a high-temperature lamp-reflector assembly and operate reciprocably to and from a position shielding a coated substrate from heat generated by such lamp assembly during interruptions in movement of the substrate.

It is still another object of the invention to provide a shutter system which will not interfere with the cooling of the high-temperature lamp-reflector assembly with which it cooperates.

SUMMARY OF THE INVENTION

The objects of the invention are accomplished by a shutter system cooperatively associated with a high temperature lamp-reflector block assembly for curing a photosensitive coating on a substrate moving adjacent the reflector block. The lamp-reflector block assembly comprises a reflector block having an outer surface and an inner reflective surface about an opening within which is mounted a high temperature lamp. The shutter system mainly comprises a solid, substantially flat cantilevered shutter plate, a double acting cylinder with piston rod, two support-guide rod bearing assemblies and bracket members. In another variation of the invention the objectives are accomplished by forming the shutter plater in sections which include conduits for the circulation of a refrigerated liquid.

BRIEF DESCRIPTION OF THE DRAWINGS

The nature of the invention will be more clearly understood by reference to the following description, the appended claims and the several views illustrated in the accompanying drawings.

FIG. 4 is a side view of the lamp-reflector block assembly and shutter system of FIG. 2.

FIG. 5 is a plan view of the lamp-reflector block assembly and shutter system of FIG. 2.

FIG. 7 is an isometric view, partially in section of another embodiment of the shutter plate of the cooperatively associated lamp-reflector block assembly and shutter system invention.

FIG. 8 is an end view of the shutter plate assembly of FIG. 7.

FIG. 9 is a side view of the shutter plate assembly of FIG. 7.

DESCRIPTION OF THE PREFERRED EMBODIMENT

Figure 1:
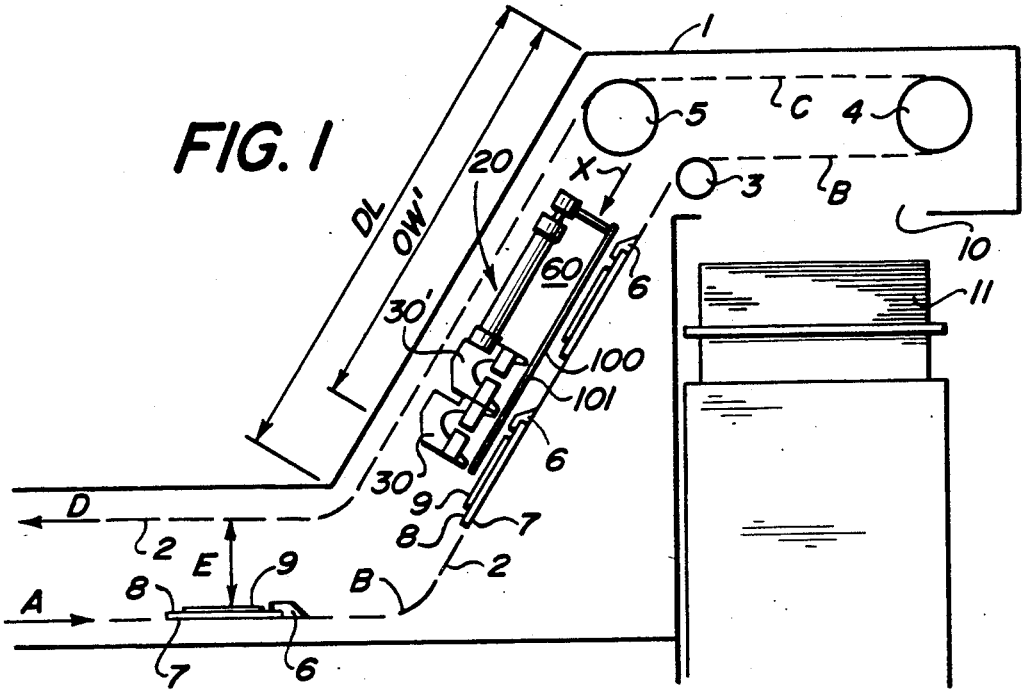
FIG. 1 is a schematic view of the delivery section at the end of a multi-stand, multi-color, sheet-fed printing press through which a coated substrate is passed for the purpose of drying the coating by means of the cooperatively associated high temperature lamp-reflector block assembly and shutter system of this invention.

Referring to FIG. 1 there is shown a delivery section 1 at the end of a multi-stand, multi-color sheet-fed printing press, not shown, capable of handling coated sheets of various widths at a speed between about 300 to 550 feet per minute. Feed chain 2 moves from the multi-stand section of the press in the direction of arrow A along bottom pass line B. Chain 2 continues along bottom pass line B, upwardly and over guide roller 3 and around drive sprocket 4 where it reverses direction. Chain 2 further continues along top pass line C over sprocket 5 and downwardly, traveling from delivery section 1 in the direction of arrow D and returns to the multi-stand section of the press.

Spaced along chain 2 are a plurality of releasable clamps 6 that engage the leading edges of sheets 7 which rest upon and are transported through the press and delivery section 1 by chain 2 as it moves through such section. On the upper surface 8 of each sheet 7 is a thin coating 9 of ink or chemical that has been placed on surface 8 during the passage of sheet 7 through the multi-stand section of the press. After each sheet 7 passes over guide roller 3, clamps 6, which engage the leading edge of the sheet, release and it drops through delivery section opening 10 onto the top of stack 11 of sheets 7 from where they can be moved subsequently to a desired location.

As sheets 7 resting on feed chain 2 travel through delivery section 1 along bottom pass line B, they move with very limited clearance E between coatings 9 and chain top pass line C. As sheets 7 are conveyed on feed chain 2 through delivery section 1 along bottom pass line B, they pass between cooperatively associated combination lamp-reflector block units and shutter system assembly 20, which includes side-by-side lamp-reflector block units 30 and 30' and shutter system 60.

As best shown in FIGS. 2 through 5, lamp-reflector block unit 30, shown as one unit for ease of explanation, comprises reflector block 40, lamp mountings 31 and 32 and lamp 33. Reflector block 40, which is made of extruded aluminum, has a cavity 41 in the shape of a parabolic trough having a reflective surface 42 and opening 43. Reflector block 40 has an outside surface 44 which includes vertical side 45, sloped top portion 46, flat top portion 47, upper vertical side portion 48, horizontal side portion 49 and lower vertical side portion 50. Block 40 has ends 51 and 52 and liquid coolant conduits 53 and 54 that extend longitudinally through reflector block 40 from end 51 to end 52. Coolant conduits 53 and 54 are connected to appropriate liquid coolant feed and discharge units, not shown, which connect with a refrigerating apparatus, not shown. Reflector block 40 has a length L and a width W which is only slightly wider than reflector cavity opening 43.

The main elements of shutter system 60 are cantilevered shutter plate 61, double acting pneumatically operated cylinder 64 with piston rod 65 and guide-support rod, bearing assemblies 70 and 70'. Shutter plate 61 is a solid, substantially flat plate.

Figure 3:
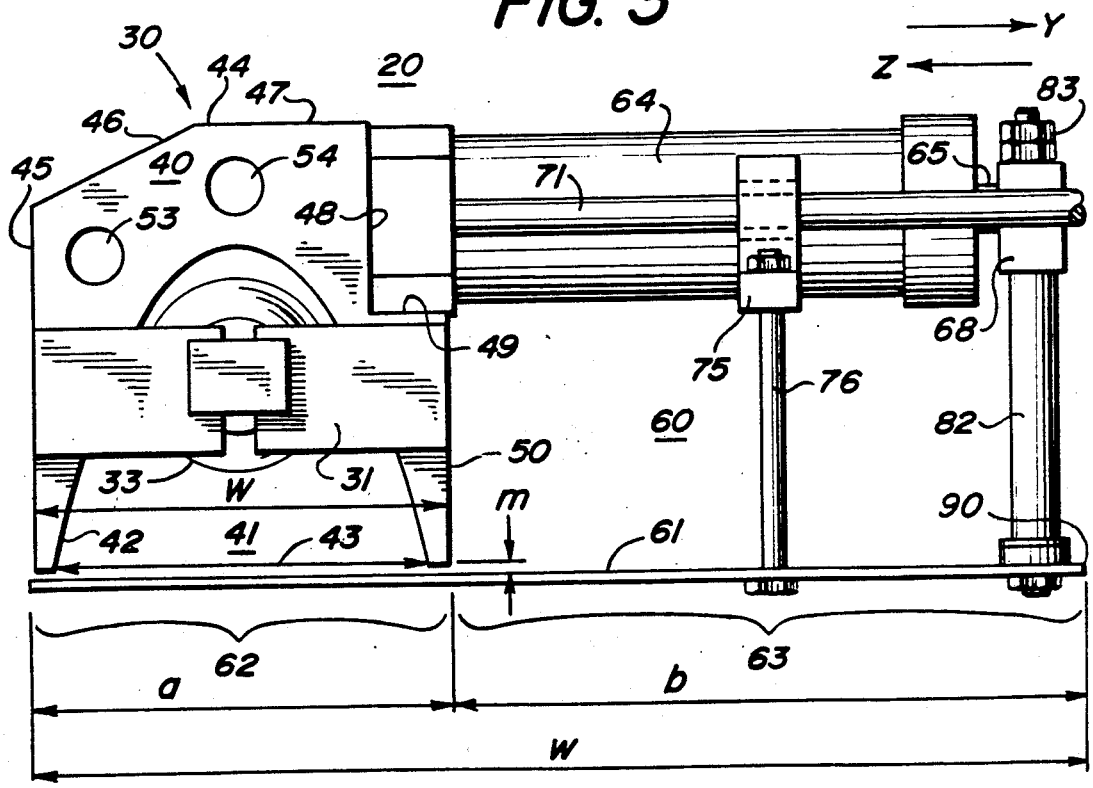
FIG. 3 is an end view of the lamp-reflector block assembly and shutter system of FIG. 2.
Figure 2:
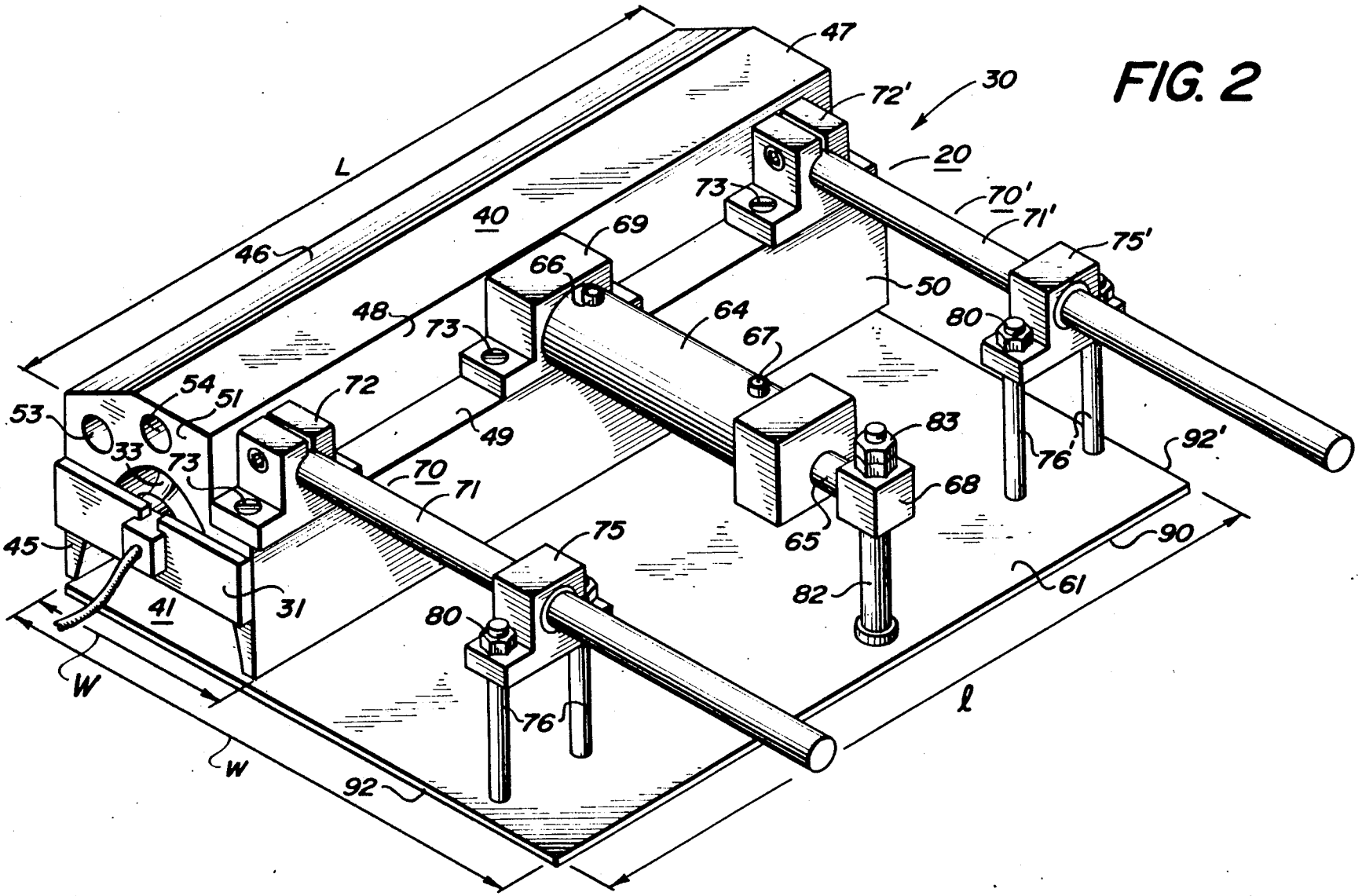
FIG. 2 is an isometric view of the cooperatively associated single lamp-reflector block assembly and shutter system of this invention as shown in FIG. 1.

As shown in FIGS. 2 and 3, cantilevered shutter plate 61 has a length l and a width w and includes a reflector block portion 62 and outer portion 63 which extend longitudinally of plate 61, i.e. for its length l. Plate reflector block portion 62 has a width a equal to the width W of reflector block 40 and plate outer portion 62 has a width b. Double acting pneumatically operated cylinder 64 has air ports 66 and 67 connected by lines, not shown, to a source of pressurized air. Cylinder 64 and piston rod 65 extend transversely of reflector block 40, and piston rod 65 has an outer end, not shown, which connects with clevis device 68. The inner end, not shown, of cylinder 64 is secured in mounting block 69 that is fastened to reflector block horizontal side portion 49. Guide-support rod bearing assemblies 70 and 70' are spaced from and located on either side of cylinder 64 and extend parallel to cylinder 64 and cylinder rod 65 and transversely of reflector block 40. Bearing assembly 70 includes guide-support rod 71 and cooperatively mounted anti-friction bearing pillow block 75, and assembly 70' includes guide support rod 71' and cooperatively mounted anti-friction bearing pillow block 75'. The inner end of guide support rod 71 is secured within mounting block 72 and the inner end of guide support rod 71' is secured within mounting block 72'. Mounting block 69 for cylinder 64 and mounting blocks 72 and 72' for guide-support rod 71 and 71', respectfully, are fastened to reflector block horizontal side portion 49 in any convenient manner as, for example, by machine screws 73. The center lines, not shown, of cylinder 64 and piston rod 65 extend in a horizontal plane, not shown, parallel to and spaced above reflector plate 61 and guide support rods 71 and 71' extend in a horizontal plane, not shown, parallel to and spaced above shutter plate 61. Guide-support rods 71 and 71' are spaced above and inwardly of edges 92 and 92' respectively of plate 61

Extending from bearing pillow block 75 downwardly to shutter plate outer portion 63 are shutter plate outer support members 76, and extending from bearing pillow block 75' downwardly to shutter plate outer portion 63 are shutter plate outer support members 76'. Support members 76 and 76' are fastened at their upper ends to bearing pillow blocks 75 and 75', respectively, in any convenient manner, as by nuts 80. Support members 76 and 76' are fastened at their lower ends to shutter plate outer portion 63 in any convenient manner, as by nuts 81. Extending from clevis device 68 secured to the outer portion of piston rod 65 and extending downwardly to shutter plate outer portion 63 is shutter plate center outer support member 82. Center outer support member 82 is fastened to clevis device 69 in any convenient manner as, for example, clevis nuts 83 and is fastened to reflector block shutter plate outer portion 63 in any convenient manner, as for example, bottom nuts 84. Shutter plate 61, which is soley or independently supported by means of support members 76, 76' and 82 fastened to shutter plate outer portion 63 and without any other support is of cantilevered construction.

The manner of operating the above described apparatus is illustrated in FIG. 1. When a sheet-fed printing press is operating well, coated sheets 7 are conveyed on chain 2 through delivery section 1 and pass adjacent lamp-reflector block units 30 and 30' which have ultraviolet lamps, not shown, that cure coatings 9 on such sheets. However, when for any reason, chain 2 stops, the press control system, not part of this invention, automatically initiates operation of shutter system 60 to move reflector plate 100 in the direction of arrow X so that shutter reflector block portion 101 moves between the bottom of reflector block units 30 and 30' and coated sheets 7 to shield them from the heat of the lamps, not shown, within such reflector blocks. Reflector block portion 101 of reflector block 100 should have a width at least equal to the width of both reflector blocks 30 and 30'.

The manner of operation of the above described apparatus in conjunction with a single reflector block 40 is illustrated and described with reference to FIGS. 2 and 3. Cantilevered plate 61 of shutter system 60 is shown with plate reflector block portion 62 moved in the direction of arrow Z to a position closely adjacent opening 43 of reflector block cavity 41 so as to interrupt any radiation and heat from lamp 33 from passing, in the usual manner, to a coated sheet, not shown, passing adjacent reflector block 40. Refrigerated coolant circulated through conduits 53 and 54 functions to maintain reflector block 40 within a desired temperature range and to permit the lamp 33 to continue at normal operating temperature without damage to any of the combination lamp reflector block unit and shutter system assembly 20.

When the multi-stand press control system, not shown, signals shutter system 60 that the press will begin normal operations and that chain 2 will begin movement of coated sheets 7, pressurized air will be fed through port 66 of cylinder 64. A piston, not shown, within cylinder 44 moves piston rod 65 in the direction of arrow Y. Movement of piston rod 65 connected through clevis device 68 and shutter plate center outer support member 82 to outer portion 63 of cantilever plate 61 also causes it to move in direction Y and withdraw plate reflector block portion 62 from its position adjacent reflector block cavity opening 43. Thereafter coated sheets, not shown, passing adjacent reflector block opening 43 will be cured by the heat and radiation from lamp 33.

At such time as the press control system activates shutter system 60 to move shutter plate 61 in direction of arrow Z, air fed to cylinder air port 67 will move piston rod 65 and cantilever plate 61 in the direction of arrow Z so as to move plate reflector block portion 63 adjacent reflector block opening 43 to act as a shield and prevent radiation and heat from lamp 33 from passing to a substrate. Shutter plate 61 is made of ¼ inch or heavier, substantially flat aluminum plate, which yields significant structural rigidity. This plate, depending upon the size of the lamp will vary from between approximately ½ and 15 lbs. in total mass per U.V. radiant. Cylinder 64 is a double action cylinder of the type manufactured by Compact Air Products of Westminster, South Carolina. The bore diameter and stroke length of cylinder 64 is a function of the length and width of shutter plate 61, which is a function of the number and length of reflector block units 40 to be shielded by plate 61. Bearing pillow blocks 75 and 75' are ball bushing linear bearing pillow blocks, i.e. anti-friction bearings, of the type manufactured by Thomson Industries, Inc. of Port Washington, New York. Guide-support rods 71 and 71' are approximately ⅜ of an inch diameter.

As shown in FIG. 2, the length l of cantilevered plate 61 is about equal to the length L of reflector block 40 to insure that no radiation and heat from lamp 33, mounted within cavity 41, by-passes plate reflector block portion 62 when it is moved to a shielding position adjacent reflector block opening 43. The length l of cantilevered plate 61 should be slightly longer than the length of lamp 33 within block cavity 41. The overall width a of plate reflector block portion 62 is equal to width a when there is one reflector block 40 to be shielded, as shown in FIG. 3, 2*a* when there are two reflector blocks 40 and 3*a* when there are three reflector blocks 40, etc. As best shown in FIG. 3, the overall width w of plate reflector block 61, when used with a single reflector block 40 is equal to width a of reflector block portion 62, which is equal to the width W of reflector block 40, plus an additional outer end width b sufficient to fasten shutter plate outer support members 76 and 76' and shutter plate center outer support member 82 adjacent plate outer end 90. The preferred width w of cantilevered plate 61 for use with a single reflector block 40 is about one and one-quarter (1¼) to two (2) times the width W of reflector block 40.

In the preferred embodiment of the invention, reflector block 40 has a width W of about 2½ inches and a height H of about 2⅞ inches. The clearance m, as shown in FIGS. 3 and 4, between the bottom of reflector block 40 and the top of cantilever plate 61 is about 1/16 of an inch; thus the overall height h of system 20, including reflector block height H, clearance C and plate thickness of about ¼ inch, is about 3-3/16 inches. Plate 61 has a width w of about 4⅛ inches and a length L aobut equal to length L of reflector block 40, which may range from about 10 inches 80 inches, depending upon the width of the press in which the block is installed.

As shown in FIG. 5, in which the extended position of plate 61 is shown in phantom, the overall operating width OW for combination lamp-reflector block unit and shutter system 20 is equal to width W of reflector block 30 and width w of reflector plate 61. In the preferred embodiment the overall operating width OW of system 20 is about 6⅝ inches for use with a single reflector block. In FIG. 1, the overall operating width OW' of a system with two reflector block units 30 and 30' is about 9⅛ inches. Thus the system 20 of the preferred embodiment can be placed into a press delivery section 1 having a length DL of about 17 inches and clearance E of only about 3⅜ inches between coatings 9 of sheets 7 and the underside of chain 2.

The preferred embodiment of the invention in FIGS. 1-5 shows cylinder 64 secured in mounting block 69 and guide-support rods 71 and 71' secured in mounting blocks 72 and 72', with such mounting blocks fastened to reflector block horizontal side portion 49 and abutting reflector block upper vertical side portion 48. Cylinder 64 with piston rod 65 and guide-support rods 71 and 71' extend transversely from reflector block upper vertical side portion 48 and from mounting blocks 69, 72 and 72'. Bearing pillow blocks 75 and 75', which are cooperatively mounted on guide-support rods 70 and 71, respectively, move along such rods as movement of piston rod 65 causes cantilever plate 61 to move reciprocably.

Figure 6:
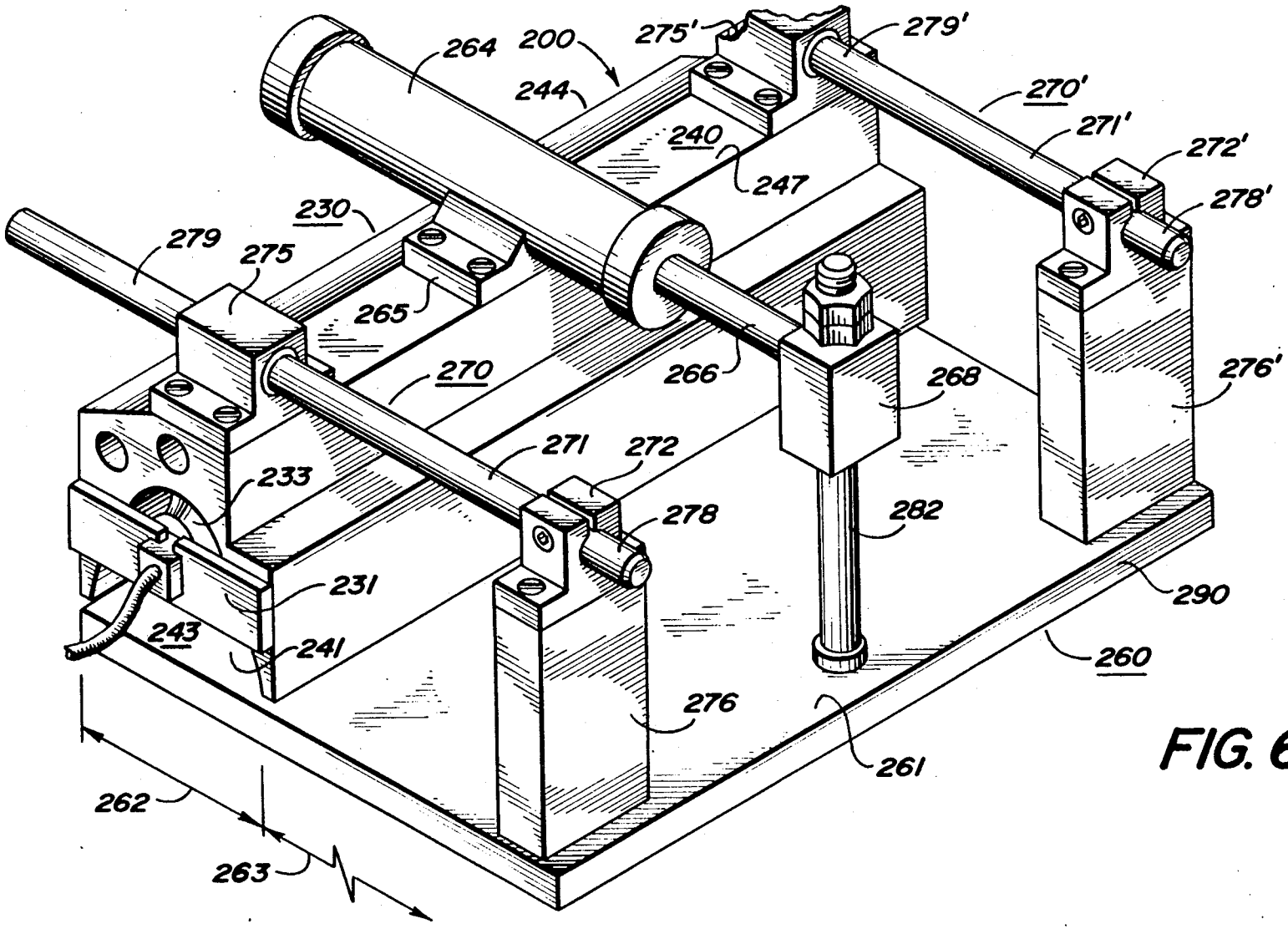
FIG. 6 is an isometric view of another embodiment of the cooperatively associated lamp-reflector block assembly and shutter system of this invention.

In FIG. 6 there is shown another embodiment of the invention in which the elements of a combination lamp reflector block unit and shutter system assembly are positioned and operate in a somewhat different manner than the above described preferred embodiment of the invention. There is shown a combination lamp reflector block unit and shutter system assembly 200 having a lamp-reflector block unit 230 and shutter system 260. Lamp-reflector block unit 230 comprises reflector block 240 having reflector block cavity 241 with reflector block cavity opening 243. Extending within block cavity 241 and mounted on mounting brackets 231 and 232, not shown, is lamp 233. Reflector block 240 has an outside surface 244 with flat top portion 247.

Shutter system 260 mainly comprises cantilever plate 261, double acting pneumatically operated cylinder 264 with piston rod 266 and guide-support rod bearing assemblies 270 and 270'.

Shutter system cantilevered plate 261 includes longitudinally extending reflector block portion 262 and outer portion 263. Cylinder 264 includes flanges 265 and 265', not shown, which are fastened to reflector block flat top portion 247. Guide-support rod, bearing assemblies 270 and 270' are spaced from and located on either side of cylinder 264 and cylinder rod 267. Assembly 270 includes guide-support rod 271 and bearing pillow block 275, and assembly 270' includes guide-support rod 271' and bearing pillow block 275'. The outer portion 278 of guide-support rod 271 is secured within mounting block 272 and the outer portion 278' of guide-support rod 271 is secured within outer mounting block 272'. Bearing pillow blocks 275 and 275' are fastened to reflector block flat top portion 247. The inner portion 279 of guide-support rod 271 moves cooperatively through bearing block 275 and the inner portion 279' of guide-support rod 271' moves cooperatively through bearing block 275'. Extending from mounting block 272 downwardly to shutter plate outer portion 263 is shutter plate outer support member 276, and extending from mounting block 272' downwardly to shutter plate outer portion 263 is shutter plate outer support member 276'.

Cylinder piston rod 266 has an outer end, not shown, which connects with clevis device 268. Extending from clevis device 268 downwardly to shutter plate outer portion 263 is shutter plate outer portion center support member 282. Shutter plate outer support member 276 and 276' and shutter plate outer portion center support member 282 are fastened adjacent plate edge 290 in a manner well known to those skilled in the art.

Shutter system 260 operates in a manner similar to that of the preferred embodiment of this invention except for the fact that guide support rods 271 and 271' have their outer portions 278 and 278', respectively, secured to shutter plate outer portions 263 and their inner portions 279 and 279' move reciprocably within bearing blocks 275 and 275'. Thus the outer portions 278 and 278' of guide-support rods 71 and 71' do not move beyond plate side edge 290. On the other hand the inner portions 279 and 279' of guide-support rods 271 and 271', respectively, move reciprocably within bearing blocks 275 and 275', respectively, such that the inner portions 279 and 279' extend through bearing blocks 275 and 275' and beyond reflector block 240 when shutter plate 261 is moved to place shutter plate reflector block portion 262 in position opposite reflector block cavity opening 243 to act as a shield and protect an adjacent substrate from radiation and heat from lamp 233.

In FIG. 7, 8 and 9 are shown another embodiment of the shutter plate of this invention. There is shown shutter plate 361 designed for a combination lamp-reflector block unit and shutter system assembly having two reflector block units, side-by-side, as shown in FIG. 1, each having a reflector block of width W and length L as shown in FIGS. 2 and 3 and of similar construction. Shutter plate 361 comprises three sections, 362, 372 and 382 of extruded aluminum with a Z cross-section configuration. Section 362 has a flat top face 363, top tongue portion 364, bottom face 365, bottom tongue portion 366 and ends 367 and 368. Extending longitudinally through section 362 is liquid coolant conduit 369. Section 372 has a flat top face 373, top tongue portion 374, bottom face 3.75, bottom tongue portion 376 and ends 377 and 378. Extending longitudinally through section 372 is liquid cooling conduit 379. Section 382 has a flat top face 383, top tongue portion 384, bottom face 385, bottom tongue portion 386 and ends 387 and 388. Extending longitudinally through section 382 is liquid coolant conduit 389. Top faces 363, 373 and 383 of sections 362, 372 and 382, respectively, have a width N equal to the W of the reflector blocks with which shutter plate is to be used. Each section also has a length L equal to length L of the reflector block with which shutter plate is to be used.

Top tongue portion 364 of section 362 overlaps bottom tongue portion 376 of section 372 and sections 362 and 372 are fastened together by countersunk machine screws 390 which extend from top face 363 of section 362 through tongue portions 364 and 376 to bottom face 375 of section 372. In similar fashion, top tongue portion 374 of section 372 overlaps tongue portion 386 of section 382 and sections 372 and are fastened together by countersunk machine screws 3 extending from top surface 373 of section 372 through tongue 374 and 386, to bottom face 385 of section 382. Top faces of and 373 of sections 362 and 372, respectively, comprise reflector block portion 391 of plate 361 and top face 383 of section 382 comprises outer portion 392 of plate 361. Extending upwardly from top face 383 of section 382, i.e. outer section 392, are shutter plate outer support members 393 and 393' and shutter plate center outer support member 394. Top faces 363, 373 and 383 of sections 362, 372 and 382, respectively, of shutter plate 361 are substantially flat and smooth. Such sections have a thickness T of about 9/16 of an inch and liquid coolant conduits 369, 379 and 389 have a diameter of about 5/16ths of an inch. Conduits 369, 379 and 389 are connected by flexible tubing, not shown, to a refrigerating system, not shown, in a manner well known to those skilled in the art. If desired tongue portion 366 of section 362 and tongue 384 of section can be removed so that the outside edges of such plates are flat.

Refrigerated liquid coolant at a temperature of between about 45° F. and 75° F. is circulated through the reflector blocks of the above described embodiments of this invention and through the liquid cooled shutter plate 361 of the immediately above described shutter embodiment of this invention. The length of the shutters for the embodiments of the invention described above will vary with the length of the reflector blocks and their lengths are dependent upon the widths of the presses in which such blocks are mounted. The different shutter lengths also require different piston stroke lengths and the piston stroke lengths and bores are determined by the length and width of the shutter plates. The type of piston used is dependent upon a particular machine installation, since different pistons have different heights, dead areas, and mounting fixtures. In all instances, the piston that is specified should operate smoothly to permit efficient operation of the reciprocally moved shutter plates, whether they are running in a horizontal, sloping or vertical plane.

The above described embodiments of the invention perform satisfactorily in installations up to 60 inches long. That is the shutter plates operate effectively with a center driven piston and spaced therefrom two guide-support rod bearing assemblies. For installations longer than 60 inches a third guide-support rod bearing assembly may be required. Although the embodiments of the invention described above have been affixed to the reflector block directly, this is not necessary. The shutter assemblies may be fastened to a suitable mounting device spaced from the reflector block and operated in a manner similar to that described above.

The major benefits of the apparatus of this invention as described above are:

- it has extreme rugged design integrity and will operate mechanically, reliably under extreme environments;
- the heat sink action of the shutter plate, particularly the liquid cooled plate, permits the associated lamp to run continually i.e. without shutting down, and no delays are required for restriking the lamp arc; and shielding from heat of the are below the shutter from heat, particularly by the water cooled shutter plate, ensures that there is no overheating of the coated substrates passing beneath the shutter or of the machinery and the equipment mounted adjacent to the lamp-reflector block assemblies.

While the apparatus of this invention has been described in a preferred manner and with other embodiments, the description has been simplified by avoiding reference to detailed piping, valving and controls that are inherent in any such apparatus and well known to those skilled in the art. In the liquid cooled shutter plate described above any acceptable liquid coolant may be used and the tubing between the coolant passage may be in either a series, series parallel or complete parallel inlet and outlet arrangement. It is further recognized that modifications and variations can be made by those skilled in the art to the above described apparatus without departing from the spirit and scope thereof as defined in the appended claims.

I claim:

1. A shutter system for use with a reflector block means having a high-temperature lamp mounted within a cavity thereof for curing a coating on a substrate moving adjacent said reflector block means, comprising:

(A) cylinder means having:
  (i) a piston rod extending therefrom;
(B) cantilevered shutter means having:
  (i) an inner portion; and
  (ii) an outer portion connected with said cylinder means piston rod;

whereby reciprocal movement of said piston rod moves the inner portion of said shutter means to a position between said reflector block means and said substrate when movement thereof is interrupted and away therefrom when said substrate is moving.

2. The shutter system of claim 1 in which said cantilevered shutter means is a solid plate having a substantially flat top surface and the overall width of said shutter means is between about one and one-quarter to twice the width of said reflector block means and the inner portion of said plate has a width at least about equal to the width of said reflector block means.

3. The shutter system of claim 1 wherein said cylinder means is mounted on said reflector block means and extends transversely thereof.

4. A shutter system for use with at least two reflector block means, each having a high-temperature lamp within a cavity thereof for curing a coating on a substrate moving adjacent said reflector block means, comprising:

(A) cylinder means having a piston rod extending therefrom;
(B) cantilevered shutter means having:
  (i) an inner portion having a width equal to the width of said reflector block means; and
  (ii) an outer portion connected with said cylinder means piston rod.

5. The shutter system of claim 4 in which said cylinder means is mounted transversely on said reflector block means.

6. The shutter system of claim 4 in which the center line of said cylinder means lies in a plane spaced from the plane of said shutter means.

7. A shutter system for use with a reflector block means having a high-temperature lamp mounted within a cavity thereof for curing a coating on a substrate moving adjacent said reflector block means, comprising:

(A) cylinder means having:
  (i) a piston rod extending therefrom;
(B) shutter means having:
  (i) an inner portion; and
  (ii) an outer portion; and
(C) support means extending between said piston rod and the outer portion of said shutter means for cantilevered support therein;

whereby reciprocal movement of said piston rod within said cylinder means moves the inner portion of said shutter means into position between said reflector block means and said substrate when movement thereof is interrupted and away from said position when said substrate is moving.

8. The shutter system of claim 7 in which said shutter means is a solid plate having a substantially flat top surface, the overall width of said shutter plate is between one and one-quarter to twice the width of said reflector block means and the inner portion of said plate has a width at least about equal to the width of said reflector block means.

9. The shutter system of claim 7 in which said cylinder means is mounted on said reflector block means and extends transversely thereof.

10. The shutter system of claim 9 in which the center line of said cylinder means and piston rod lies in a plane spaced from the plane of said shutter means.

11. A shutter system for use with a reflector block means having a high-temperature a lamp mounted within a cavity thereof for curing a coating on a substrate moving adjacent said reflector block means, comprising:

(A) cylinder means mounted on said reflector block means and extending transversely thereof and having:
  (i) a piston rod extending therefrom;
(B) solid plate shutter means for movement within a plane spaced from the plane of said cylinder means and piston rod, having a substantially flat top surface and a width between about one and one-quarter to twice the width of said reflector block means and having:
  (i) an inner portion with a width at least equal to about the width of said reflector block means cavity; and
  (ii) an outer portion;
(C) support member means extending between said cylinder means piston rod and the outer portion of said shutter plate for cantilevered support thereof;

whereby reciprocal movement of said piston rod moves the inner portion of said shutter means into position between said reflector block means and said substrate when movement thereof is interrupted and away therefrom when said substrate is moving.

12. Apparatus for curing a photosensitive coating metal on a moving substrate, comprising:

(A) a reflector block means having:
  (i) a longitudinally extending cavity having:
    (a) a reflective surface; and
    (b) a cavity opening;
(B) lamp means within said reflector block means cavity;
(C) cylinder means having:
  (i) a piston rod cooperatively associated therewith;
(D) guide-support, bearing assembly means comprising:
  (i) guide-support means; and
  (ii) bearing means cooperatively associated with said guide-support means;
(E) shutter means having:
  (i) an inner portion; and
  (ii) an outer portion;
(F) support member means extending between the piston rod of said cylinder means and extending between said guide-support, bearing assembly means and the outer portion of said shutter means for cantilevered support thereof;

whereby reciprocal movement of said piston rod moves said shutter means to position the inner portion thereof between said reflector block means cavity opening and said substrate when movement thereof is interrupted and away from said position when said substrate is moving.

13. The apparatus of claim 12 in which there is at least one coolant passage extending through said reflector block means and at least one coolant extending through said shutter means.

14. The apparatus of claim 12 in which said shutter means is a solid plate having a substantially flat surface and the overall width of said shutter means is between about one and one-quarter to twice the width of said reflector block means and the inner portion of said shutter means has a width at least about equal to the width of said reflector block means.

15. The apparatus of claim 14 wherein:

(A) said cylinder means is mounted at least partially on said reflector block means to extend transversely thereof; and
(B) said guide support, bearing assembly means is mounted at least partially on said reflector block means to extend transversely thereof.

16. The apparatus of claim 12 wherein said guide support, bearing assembly means further comprises:

(A) guide-support rod means;
(B) bearing means; and
(C) mounting block means.

17. The apparatus of claim 12 wherein:

(A) said guide-support bearing assembly means comprises:
  (i) two guide-supported rod means;
  (ii) bearing means cooperatively associated with each of said guide-support rod means;
(B) each said support member means includes:
  (i) member means extending between said cylinder piston rod and the outer portion of said shutter means; and
  (ii) member means extending between each said bearing means and the outer portion of said shutter means; and
  (iii) mounting means at the inner end of each said guide-support rod means.

18. The apparatus of claim 12 wherein said shutter means comprises:

(A) a first reflector block means section having:
  (a) a coolant passage extending therethrough, and
  (b) a width equal to about the width of said reflector block means; and
(B) a second outer section having:
  (i) a coolant passage extending therethrough.

19. Apparatus for curing a coating material on a moving substrate comprising:

(A) elongated reflector block means having:
  (i) a longitudinally extending cavity having:
    (a) a cavity opening;
(B) elongated lamp means mounted with the cavity of said reflector block means;
(C) cylinder means mounted transversely of said reflector block means and having:
  (a) a piston rod extending therefrom;
(D) guide-support, bearing assembly means extending transversely of said reflector block means comprising:
  (i) two guide-support means;

(ii) mounting means for each guide support means secured to said reflector block means; and (iii) bearing block means, cooperatively associated with each of said guide support means;

(E) substantially flat cantilevered shutter means having:

(i) a length at last the length of said lamp means;

(ii) a reflector block means portion having a width at least equal to the width of said reflector block means; and (iii) an outer portion;

(F) support means extending between the piston rod of said cylinder means and the outer portion of said shutter means; and (G) support means extending between each of said bearing block means and the outer portion of said shutter means; whereby reciprocal movement of said piston within said cylinder means moves the shutter means to position the inner portion thereof between said reflector block means cavity and said substrate when movement thereof is interrupted and away from said position when said substrate is moving.

20. The apparatus of claim 19 wherein said reflector block means comprises at least two reflector blocks, an elongated lamp means is mounted within the cavity of each said reflector block and said shutter means reflector block means portion has a width at least about equal to the width of said reflector block means.

21. The apparatus of claim 19 wherein said reflector block means includes a flat portion on the outer surface thereof and said cylinder means and said mounting means for each guide-support means is secured to the flat portion of said reflector block means.

22. The apparatus of claim 19 wherein said reflector block means includes at least one coolant passage and said shutter means reflector block means portion includes at least one coolant passage.

23. Apparatus for curing a coating on a moving substrate comprising:

(A) an elongated reflector block means having:

(a) a longitudinally extending cavity having:

(i) a cavity opening;

(B) elongated lamp means mounted within the cavity of said reflector block means;

(C) cylinder means mounted transversely of said reflector block means and having:

(a) a piston rod extending therefrom;

(D) guide-support bearing assembly means extending transversely of said reflector block means comprising:

(i) two guide-support means;

(ii) mounting means for each guide-support means; and (iii) bearing block means cooperatively associated with each guide-support means and secured to said reflector block means;

(E) substantially flat cantilevered shutter means having:

(i) a length at least the length of said lamp means, and (ii) reflector block means portion having a width at least equal to about the width of the cavity of said reflector block means; and (iii) an outer portion;

(F) support member means extending between the piston rod of said cylinder means and the outer portion of said shutter means; and (G) support member means extending from each of said guide-support mounting means and the outer portion of said shutter means whereby reciprocal movement of said piston within said cylinder means moves said shutter means to position the inner portion thereof between said reflector block means cavity and said substrate when movement thereof is interrupted and away from said position when said substrate is moving.

24. The apparatus of claim 23 wherein said reflector block means includes a flat portion on the outer surface thereof.

25. The apparatus of claim 23 wherein said reflector block means includes at least one coolant passage and said shutter means inner portion includes at least one coolant passage.

26. The apparatus of claim 23 in which said reflector block means comprises at least two side-by-side reflector block means, there is an elongated lamp means mounted within the cavity of each said reflector block means and said shutter means reflector block means portion has a width at least about equal to the width of said reflector block means.

* * * * *

UNITED STATES PATENT AND TRADEMARK OFFICE

CERTIFICATE OF CORRECTION

PATENT NO. : 5,048,198

DATED : September 17, 1991

INVENTOR(S) : Joseph T. Burgio, Jr.

It is certified that error appears in the above-identified patent and that said Letters Patent is hereby corrected as shown below:

Col. 5, line 11, after "plate 61" add a period --.--

Col. 5, line 30, "soley" should be --solely--.

Col. 6, line 49, before "plate" add the word --cantilever--.

Col. 6, lines 49-50, delete "reflector block".

Col. 6, line 66, "clearance C" should read --clearance m--.

Col. 6, line 68, "aobut" should be --about--.

Col. 7, line 1, after "to", add --the--.

Col. 7, line 2, after "10 inches", add --to--. .

Col. 7, line 56, "rod 267" should read --rod 266--.

Col. 8, line 54, before "W" add the word "width".

Col. 8, line 56, "equal to length" should read -- equal to the length--.

Col. 8, line 64, after "overlaps" add the word --bottom--.

UNITED STATES PATENT AND TRADEMARK OFFICE

CERTIFICATE OF CORRECTION

PATENT NO. : 5,048,198

DATED : September 17, 1991

INVENTOR(S) : Joseph T. Burgio, Jr.

It is certified that error appears in the above-identified patent and that said Letters Patent is hereby corrected as shown below:

Col. 8, line 65, after "372 and" add the word --382--.

Col. 8, line 66, "screws 3" should be --screws 390--.

Col. 8, line 67, after "tongue", add --portions--.

Col. 8, line 68, after "Top faces" add --363--.

Col. 9, line 16, after "section" add --382-.

Signed and Sealed this

Sixth Day of July, 1993

Michael K. Kirk

MICHAEL K. KIRK

*Acting Commissioner of Patents and Trademarks*

*Attest:*

*Attesting Officer*